US011491633B2

(12) United States Patent
Cerfeuillet

(10) Patent No.: US 11,491,633 B2
(45) Date of Patent: Nov. 8, 2022

(54) POWER TOOLS FOR CRIMPING OR CUTTING OBJECTS AND METHODS OF ASSEMBLY

(71) Applicant: DUBUIS ET CIE S.A.S., Villebarou (FR)

(72) Inventor: Vincent Cerfeuillet, Maslives (FR)

(73) Assignee: DUBUIS ET CIE S.A.S., Villebarou (FR)

( * ) Notice: Subject to any disclaimer, the term of this patent is extended or adjusted under 35 U.S.C. 154(b) by 282 days.

(21) Appl. No.: 16/107,273

(22) Filed: Aug. 21, 2018

(65) Prior Publication Data

US 2019/0061135 A1 Feb. 28, 2019

(30) Foreign Application Priority Data

Aug. 31, 2017 (EP) ..... 17306123

(51) Int. Cl.
*B25F 5/00* (2006.01)
*B25B 28/00* (2006.01)
(Continued)

(52) U.S. Cl.
CPC ..... *B25F 5/008* (2013.01); *B25B 27/10* (2013.01); *B25B 28/00* (2013.01); *B25F 5/005* (2013.01);
(Continued)

(58) Field of Classification Search
CPC . B25F 5/008; B25F 5/02; B25B 27/10; B25B 28/00; B21D 39/046; H01R 43/042;
(Continued)

(56) References Cited

U.S. PATENT DOCUMENTS 5,052,497 A * 10/1991 Houben ..... B25D 16/00 173/109
5,725,086 A 3/1998 Cooper
(Continued)

FOREIGN PATENT DOCUMENTS

DE 102011075196 A 11/2012
EP 0714110 A 5/1996
(Continued)

OTHER PUBLICATIONS

Be Your Own Handyman @ Home, How to Clean an Air Conditioning Filter (reusable)—Be Your Own Handyman @ Home, Jul. 26, 2013, Youtube, https://www.youtube.com/watch?v=mD6cH1FWkrg (Year: 2013).*
(Continued)

*Primary Examiner* — Shelley M Self
*Assistant Examiner* — Katie L. Parr
(74) *Attorney, Agent, or Firm* — Michael P. Leary

(57) ABSTRACT

Power tool for crimping or cutting and object, the tool having vents in the tool housing for enabling airflow wherein such vents have a partition member extending across them for restricting liquid water and dust ingress, and method of assembly. Power tool for crimping or cutting an object, the tool having a switch wherein the switch is provided on a support that is clamped between opposing tool housing portions for forming a seal to restrict the ingress of liquid water into the tool housing interior via the switch, and method of assembly. Power tool for crimping or cutting an object, the tool having an arrangement of light emitting elements directed towards an operative part of the tool for indicating operational information to a user without requiring the user to remove their gaze from the operative part of the tool in use.

20 Claims, 10 Drawing Sheets

(51) Int. Cl.

| | |
|---|---|
| ***B26B 15/00*** | (2006.01) |
| ***B25B 27/10*** | (2006.01) |
| ***B25F 5/02*** | (2006.01) |
| ***G08B 5/36*** | (2006.01) |
| ***F21V 33/00*** | (2006.01) |
| ***F21V 23/04*** | (2006.01) |

(52) U.S. Cl.
CPC ..... *B25F 5/02* (2013.01); *B26B 15/00* (2013.01); *F21V 23/0442* (2013.01); *F21V 33/0084* (2013.01); *G08B 5/36* (2013.01)

(58) Field of Classification Search
CPC ..... H01R 43/0421; H01R 43/0428; B23D 29/00; B23D 29/02; B26B 15/00
See application file for complete search history.

(56) References Cited

U.S. PATENT DOCUMENTS

| | | | | |
|---|---|---|---|---|
| 5,798,584 | A | 8/1998 | Schaeffeler et al. | |
| 8,398,465 | B2 * | 3/2013 | Hoeschele | B25F 5/008 451/359 |
| 2005/0281627 | A1 * | 12/2005 | Britz | B23Q 11/127 408/67 |
| 2009/0280731 | A1 * | 11/2009 | Nelson | B25F 5/008 451/359 |
| 2010/0107843 | A1 | 5/2010 | Lefavour et al. | |
| 2013/0255981 | A1 | 3/2013 | Noto et al. | |
| 2013/0333908 | A1 * | 12/2013 | Lennartz | B25F 5/02 173/90 |
| 2014/0080388 | A1 | 3/2014 | Lutz et al. | |
| 2014/0209338 | A1 * | 7/2014 | Harada | B23B 45/001 173/46 |
| 2014/0360243 | A1 * | 12/2014 | MacAdams | B21D 39/046 72/370.25 |
| 2017/0144289 | A1 | 5/2017 | Yamashita | |
| 2018/0326337 | A1 * | 11/2018 | Esenwein | B25F 5/008 |

FOREIGN PATENT DOCUMENTS

| | | | | | |
|---|---|---|---|---|---|
| EP | 0732714 | A | | 9/1996 | |
| EP | 3170627 | A | | 5/2017 | |
| FR | 3013251 | A1 | * | 5/2015 | B25F 5/02 |
| GB | 2383007 | A | * | 6/2003 | B25F 5/008 |
| JP | 2009262296 | A | * | 11/2009 | B25F 5/008 |
| JP | 2010036260 | A | * | 2/2010 | B25F 5/008 |

OTHER PUBLICATIONS

EP Search Report dated Mar. 29, 2021 cited in corresponding EP Application No. 20206722.

* cited by examiner

POWER TOOLS FOR CRIMPING OR CUTTING OBJECTS AND METHODS OF ASSEMBLY

CROSS-REFERENCE TO RELATED APPLICATION

This application claims priority from European Patent Application No. 17306123.5, filed on Aug. 31, 2017, the disclosure of which is incorporated herein by reference.

BACKGROUND OF THE INVENTION

This specification concerns power tools for crimping or cutting objects and methods of assembling such tools. The specification describes electro-hydraulic versions of such tools, although aspects of the invention could be used in other types of tool.

An example prior art portable electro-hydraulic tool for crimping an object is the Milwaukee® M18™ Force Logic™ 6T crimping tool. It will be appreciated that problems can occur if water, specifically rain, enters the tool when used outside. However, it should be borne in mind that airflow within the tool can assist in reducing the temperature of internal components such as the electric motor, avoiding overheating. In manufacturing portable electro-hydraulic crimping and cutting tools consideration should thus be given to the trade-off between waterproofness and cooling. Also, it is known for portable electro-hydraulic crimping and cutting tools to include a visible indicator on the side of the tool housing to indicate operational information, although users are required to remove their gaze from the operative part of the tool (e.g. the crimping jaws) to look at it and may be required to change which of their hands grips the tool in order to remove their arm from obscuring the view.

SUMMARY OF THE INVENTION

According to an aspect of the present invention there is provided a power tool comprising: a pressure generating mechanism including an electric motor and being configured to apply pressure to an object for crimping or cutting the object; a tool housing defining a vent portion to enable airflow within the tool housing for cooling of the electric motor; a frame portion urged against the interior of the tool housing and surrounding the vent portion, the frame portion being urged against the tool housing by cooperating with a component of the tool within the tool housing; and a partition member configured to restrict passage of liquid water while permitting airflow therethrough, wherein the partition member is pinched between the interior of the tool housing and the frame portion such that the partition member extends across the vent portion for restricting ingress of liquid water into contact with electrical components within the tool housing while permitting airflow.

The tool housing may define a plurality of vent portions to enable airflow for cooling of the electric motor and respective partition members may be pinched between the tool housing interior and respective frame portions surrounding the vent portions for restricting ingress of liquid water into contact with electrical components within the tool housing while permitting airflow, the frame portions comprising separate parts of a frame body.

At least one said frame portion may pivot relative to the rest of the frame body prior to being provided within the power tool.

The tool may have a plurality of said frame bodies wedged between the tool housing interior and said component of the tool within the tool housing, a first frame body being provided on one side of the tool inside the housing and a second frame body being provided on the other side of the tool inside the housing such that the partition members pinched thereby cooperate with vent portions on respective sides of the tool.

The or each said frame portion may have an inner profile corresponding in shape to the exterior of the component which wedges the at least one frame portion against the interior of the tool housing, optionally wherein the component may be a housing of the electric motor.

The interior of the tool housing may be provided with at least one feature that forms an interference fit with the or each said frame portion to restrict movement thereof.

According to another aspect of the present invention there is provided a method of assembling a power tool comprising the steps of: providing a first part of a tool housing which defines a vent portion to enable airflow within the tool housing in use; arranging a frame portion supporting a partition member within the first tool housing part such that the partition member extends across the vent portion; providing a pressure generating mechanism including an electric motor and being configured to apply pressure to an object for crimping or cutting the object; and closing the tool housing by causing the first tool housing part to cooperate with another tool housing part, such that when the tool housing is closed the partition member is pinched between the interior of the tool housing and the frame portion for restricting ingress of liquid water into contact with electrical components within the tool housing while permitting airflow.

According to another aspect of the present invention there is provided a power tool comprising: a pressure generating mechanism including an electric motor and being configured to apply pressure to an object for crimping or cutting the object; an actuator that a user can manipulate to influence operation of the pressure generating mechanism; a support on which the actuator is provided, the support having a first part of a two-part sealing mechanism around its periphery; and a tool housing formed by a plurality of tool housing parts which cooperate to form a second part of the two-part sealing mechanism and clamp the support between them such that the first and second parts of the two-part sealing mechanism cooperate to restrict ingress of liquid water into contact with electrical components of the tool within the tool housing.

One of the first and second parts of the two-part sealing mechanism may be a female part configured to receive the other part of the two-part sealing mechanism which may be a male part.

One of the first and second parts of the two-part sealing mechanism may be an overmold feature and the other part of the two-part sealing mechanism may be a channel.

The actuator may be a rocker switch and a sealing feature may be provided around an opening in the support through which a plunger of the rocker switch extends for further restricting the ingress of liquid water into contact with electrical components of the tool within the tool housing.

According to another aspect of the present invention there is provided a method of assembling a power tool comprising the steps of: providing a first part of a tool housing; providing a pressure generating mechanism including an electric motor and being configured to apply pressure to an object for crimping or cutting the object; providing a support carrying an actuator that a user can manipulate to influence operation of the pressure generating mechanism in use, the support having a first part of a two-part sealing mechanism around its periphery; closing the tool housing by causing the first tool housing part to cooperate with at least one other tool housing part such that when the tool housing is closed the housing parts cooperate to form a second part of the two-part sealing mechanism and clamp the support between them such that the first and second parts of the two-part sealing mechanism cooperate to restrict the ingress of liquid water into contact with electrical components of the tool within the housing.

According to another aspect of the present invention there is provided a power tool comprising: a pressure generating mechanism including an electric motor and being configured to apply pressure to an object for crimping or cutting the object; a plurality of light sources for illuminating a working part of the pressure generating mechanism which applies force to an object being crimped or cut in use; at least one sensor for generating output indicative of at least one operational parameter of the tool; and a controller for receiving the output generated by the at least one sensor and based on this output controlling operation of the light sources to give a visible indication of the occurrence of a predetermined condition during tool use, said visible indication being observable by a user gazing at the working part of the pressure generating mechanism which applies force to an object being crimped or cut in use.

The light sources may be distributed in a plane that is orthogonal to a major axis of the tool, optionally wherein the light sources may be circumferentially arranged around said axis.

The controller may be configured to control the light sources to give a visible indication of the occurrence of at least one of: a successful crimping or cutting cycle; an unsuccessful or incomplete crimping or cutting cycle; temperature of the electric motor exceeding a threshold amount; remaining battery power falling below a threshold amount; occurrence of a predetermined number of tool operation cycles; and a malfunction.

The controller may be configured to give a visible indication of the occurrence of a predetermined condition by causing the plurality of light sources to illuminate the working part of the pressure generating mechanism which applies force to an object being crimped or cut in use with light of a colour corresponding to the occurrence of said condition, optionally wherein each of the light sources may be an RGB LED.

The controller may be configured to cause the light sources to illuminate the working part of the pressure generating mechanism which applies force to an object being crimped or cut in use with light of a first colour for a predetermined time frame following a successful crimping or cutting cycle, whereas the controller may be configured to cause the light sources to illuminate the working part of the pressure generating mechanism which applies force to an object being crimped or cut in use with light of a second colour for a predetermined time frame following an unsuccessful or incomplete crimping or cutting cycle.

BRIEF DESCRIPTION OF THE DRAWINGS

Various aspects and embodiments of the invention will now be described by way of non-limiting example with reference to the accompanying drawings, in which.

DESCRIPTION OF THE PREFERRED EMBODIMENTS

Figure 1:
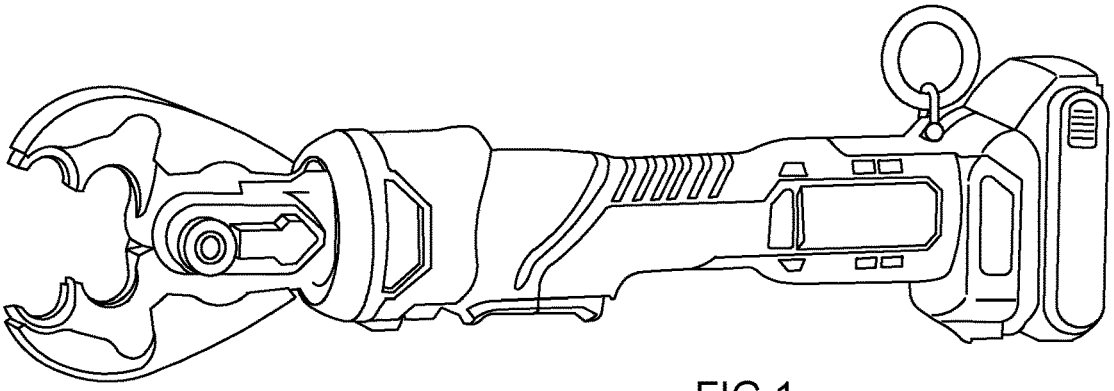
FIG. 1 illustrates an example battery powered electro-hydraulic crimping tool which embodies various aspects of the present invention.

FIG. 1 illustrates a portable electro-hydraulic crimping tool which embodies various aspects of the present invention, each of which will be described separately.

A first such aspect of the present invention is described with reference to FIGS. 2 to 9.

In some power tool embodiments, a plastic frame that supports multiple membrane portions is provided for restricting liquid water ingress through vent portions in the power tool casing while permitting airflow. The frame is retained in place within the power tool by clamping it between an internal component of the power tool (e.g. an electric motor) and an internal surface of the power tool casing. The internal surface of the power tool casing is additionally shaped to cooperate with the frame to further assist in retaining the frame in place, for example by forming an interference fit with the frame. Specific details of example embodiments will now be described.

Figure 2:
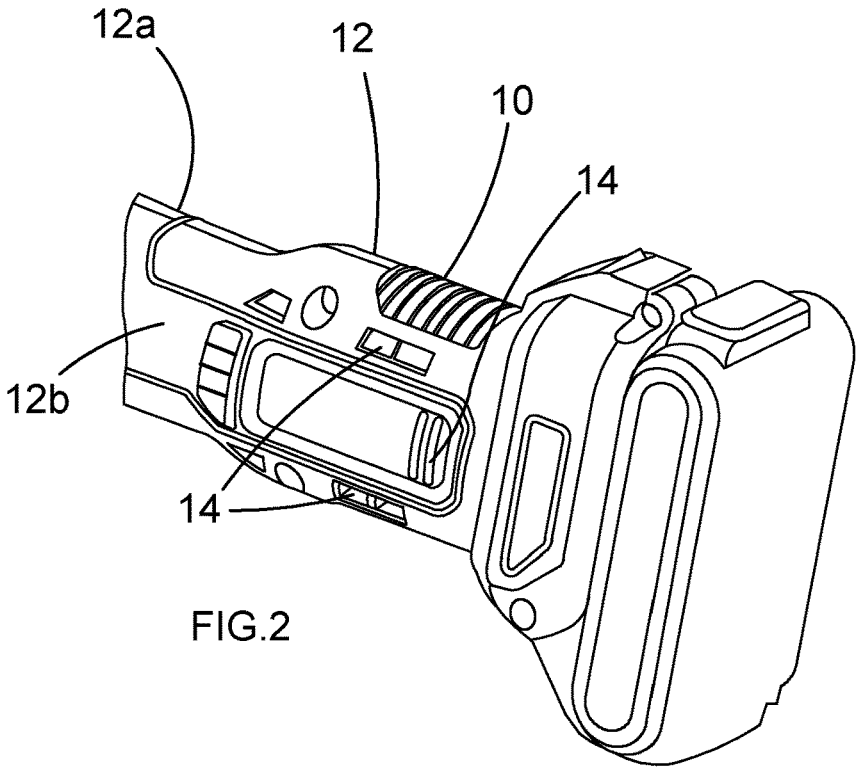
FIG. 2 is a schematic perspective view of a part of a tool.
Figure 2A:
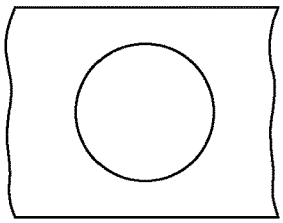
FIG. 2*a* is a schematic illustration of a vent portion having a single opening.
Figure 2B:
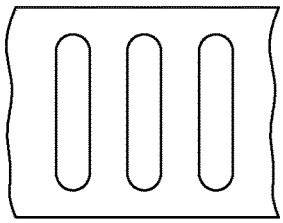
FIG. 2*b* is a schematic illustration of a vent portion having plural openings.

FIG. 2 is a close-up view of part of a portable electro-hydraulic power tool 10. The housing 12 defines a plurality of vent portions 14 to enable airflow for cooling of an electric motor within the tool. Each vent portion 14 may define a single opening as illustrated in FIG. 2*a* for example or a plurality of openings as illustrated in FIG. 2*b* for example, wherein it will be appreciated that various shapes of openings are possible. Unless mentioned otherwise reference to a vent portion hereafter is a reference to either kind, namely one having a single opening or one having a plurality of openings.

Partition members supported by a frame are arranged inside the housing 12 adjacent each of the vent portions 14 to restrict the ingress of liquid water into the tool through the vent portions while still permitting airflow for reducing the likelihood of condensation accumulating inside the housing 12.

Figure 3A:
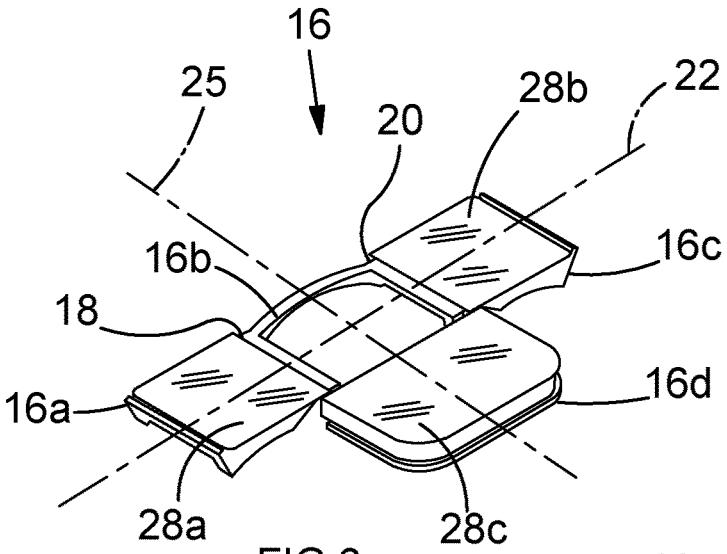
FIGS. 3*a* and 3*b* are top and bottom schematic views of a frame.
Figure 3B:
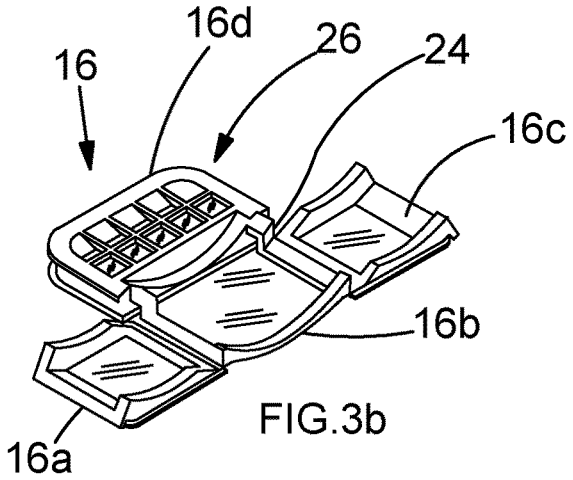
Figure 4A:
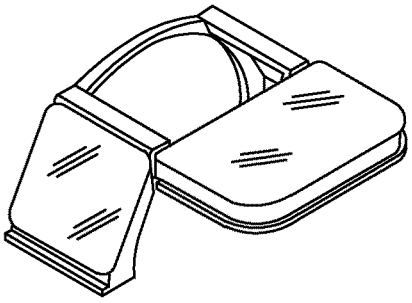
FIGS. 4*a* and 4*b* are top and bottom schematic views of the frame in FIGS. 3*a* and 3*b* after having been flexed.
Figure 4B:
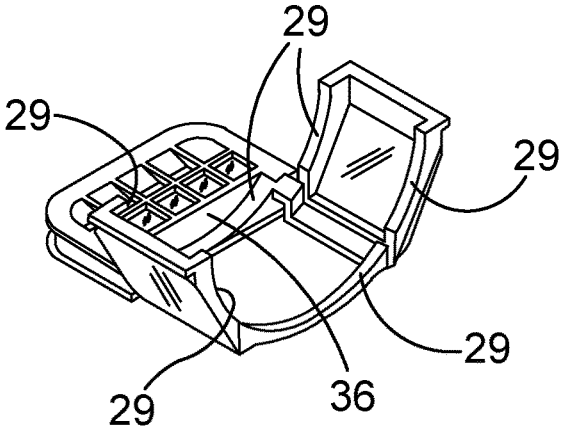
Figure 5:
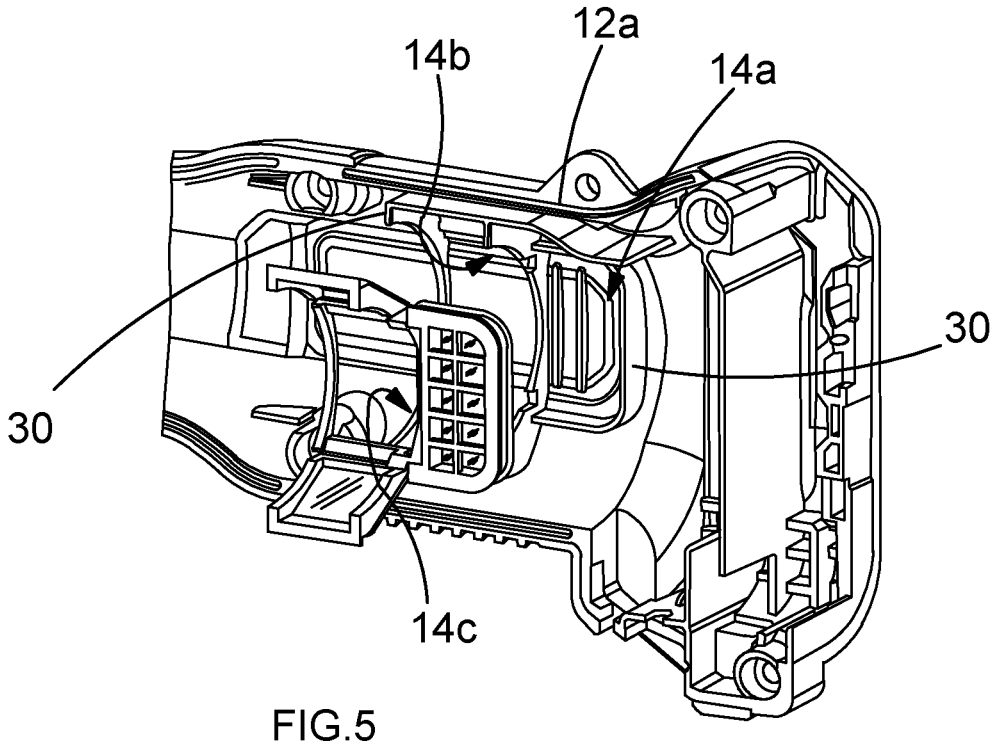
FIG. 5 is a schematic view of a frame prior to insertion into a tool housing part.

FIGS. 3*a* and 3*b* illustrate top and bottom views of a suitable frame 16. The frame 16 has first to fourth frame sections 16*a*, 16*b*, 16*c*, 16*d* each of which defines an opening. The first and second frame sections 16*a*, 16*b* have a common edge 18 coupling the two frame sections together. The third and second frame sections 16*c*, 16*b* also have a common edge 20 coupling the two frame sections together. These common edges 18, 20 are located opposite from each other, thereby providing that the first to third frame sections 16*a* to 16*c* are arranged linearly relative to each other. That is a first notional line 22 extending between the first to third frame sections 16*a* and 16*c* extends through the second frame section 16*b* as well. The frame 16 is able to flex such that the first frame section 16*a* and third frame section 16*c* can pivot relative to the second frame section 16*b* about the common edges 18, 20 which is apparent from comparing FIGS. 3*a* and 3*b* with FIGS. 4*a* and 4*b*. This can be achieved by providing an area of weakness in the region of common edges 18, 20.

The fourth frame section 16*d* is located to the side of the second frame section 16*b*.

More specifically the fourth frame section 16*d* has a common edge 24 with the second frame section 16*b* which couples the two frame sections together. A second notional line 25 perpendicular to the first notional line 22 extends between the second and fourth frame section 16*b* and 16*d*. The fourth frame section includes a grid 26 across the opening defined thereby, the purpose of which will be explained later on.

First to third partition members 28*a*, 28*b*, 28*c* are fixed to the first, third and fourth frame sections 16*a*, 16*c*, 16*d*. Moreover, these partition members 28*a*, 28*b*, 28*c* are fixed to a first side of the frame sections 16*a*, 16*c*, 16*d* and extend across the openings defined thereby. That is the first partition member 28*a* extends across the opening defined by the first frame section 16*a*, the second partition member 28*b* extends across the opening defined by the third frame section 16*c* and the third partition members 28*c* extends across the opening defined by the fourth frame section 16*d*. Furthermore, the first to third partition members 28*a*, 28*b*, 28*c* form a water tight seal around the heretofore mentioned frame sections 16*a*, 16*c*, 16*d* to restrict the passage of liquid water through the openings defined by the frame sections 16*a*, 16*c*, 16*d* although the partition members 28*a*, 28*b*, 28*c* allow both air and water vapour to pass through them.

In some embodiments the frame 16 can be formed of plastic such as polypropylene. The frame 16 can thus be formed by an injection moulding technique. Furthermore, the partition members 28*a*, 28*b*, 28*c* can comprise membranes and in some embodiments, can be formed of material such as polypropylene tissue non-woven fabric filter (e.g. material having part number 5100 obtainable from K2 Technologie, France). Various techniques can be used to fix the partition members 28*a*, 28*b*, 28*c* to the frame 16 such as gluing or ultrasonic welding. Using welding for example the peripheries of the partition members 28*a*, 28*b*, 28*c* can be welded to the sections of the frame 16 that delineate the openings defined by the first, third and fourth frame sections 16*a*, 16*c*, 16*d*.

Now with reference to FIGS. 5 to 8, during tool assembly a first tool housing part 12*a* is provided which defines first to third vent portions 14*a* to 14*c* to enable airflow for electric motor cooling. The first tool housing part 12*a* includes various standard features that will be familiar to persons skilled in the art such as screw openings for closing the housing 12 during assembly of the tool 10. Additionally, however, the first tool housing part 12*a* has receiving features 30 for cooperating with a frame 16 to restrict movement of the frame 16 after tool assembly.

In more detail, with further reference to FIGS. 5 to 8, during tool assembly a frame 16 of the kind heretofore described is engaged with the interior of the first tool housing part 12*a*. Moreover, upon engaging the frame 16 with the interior of the first tool housing part 12*a*, the fourth frame section 16*d* is supported by an edge portion 25 (see FIG. 8) that surrounds the first vent portion 14*a*. In other words, the body of the fourth frame section 16*d* delineating the opening defined by the fourth frame section 16*d* rests on the edge portion 25 surrounding the first vent portion 14*a*. As a result, the third partition member 28*c* is pinched between the edge portion 25 and the body of the fourth frame section 16*d* and thus extends across the vent portion 14*a*. Pinching the third partition member 28*c* in this manner by forcing the body of the fourth frame section 16*d* against the edge portion 25 (in a manner described later) forms a water tight seal around the first vent portion 14*a*, so liquid water is restricted from entering the tool housing via the first vent portion 14*a* although airflow is still permitted for reducing the likelihood of condensation build up inside the tool 10.

With continued reference to FIGS. 5 to 8, upon moving the frame 16 into engagement with the interior of the first tool housing part 12*a* during tool assembly the frame 16 is caused to flex in the manner heretofore described so as to correspond with the shape of the interior of the first tool housing part 12*a*. More specifically the first and third frame sections 16*a*, 16*c* pivot relative to the second frame section 16*b* such that these frame sections are also supported by respective edge portions that surrounds the second and third vent portions 14*b*, 14*c*. In other words the body of the first frame section 16*a* delineating the opening defined by the first frame section 16*a* is caused to rest on an edge portion surrounding the second vent portion 14*b*. Also, the body of the third frame section 16*c* delineating the opening defined by the third frame section 16*c* is caused to rest on an edge portion surrounding the third vent portion 14*c*. As a result, the first and second partition members 28*a*, 28*b* are pinched between these edge portions and the body of the first and third frame sections 16*a*, 16*c* respectively and thus extend across the second and third vent portions 14*b*, 14*c*. Pinching the first and second partition members 28*a*, 28*b* in this manner by forcing the body of the first and third frame sections 16*a*, 16*c* against the aforementioned edge portions (in a manner described later) forms a water tight seal around the second and third vent portions 14*b*, 14*c* such that liquid water is restricted from entering the tool housing via these vent portions although airflow is still permitted for reducing the likelihood of condensation build up inside the tool 10.

The aforementioned receiving features 30, which in the embodiment illustrated comprise a series of walls 30, protrude from the inner surface of the first tool housing part 12*a*.

This provides that when the frame 16 is moved into contact with the first tool housing part 12*a* the frame 16 is received in the space defined by the walls 30, which thereby act to restrict movement of the frame 16 except in a direction extending away from the inner surface of the first tool housing part 12*a*. With specific reference to FIG. 6 for example, the frame 16 can be caused to form an interference fit with the walls 30 on the inside of the first tool housing part 12*a* for restricting movement of the frame 16.

Figure 6:
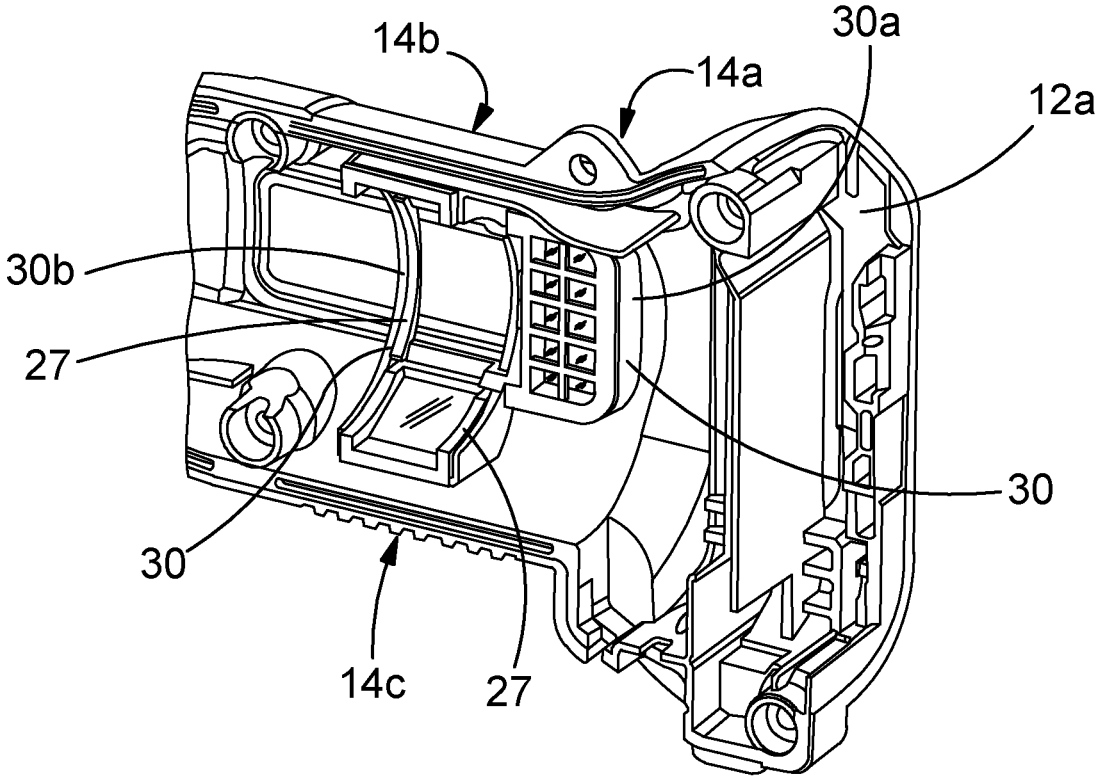
FIG. 6 is a schematic view of the frame after insertion into the tool housing part.
Figure 8:
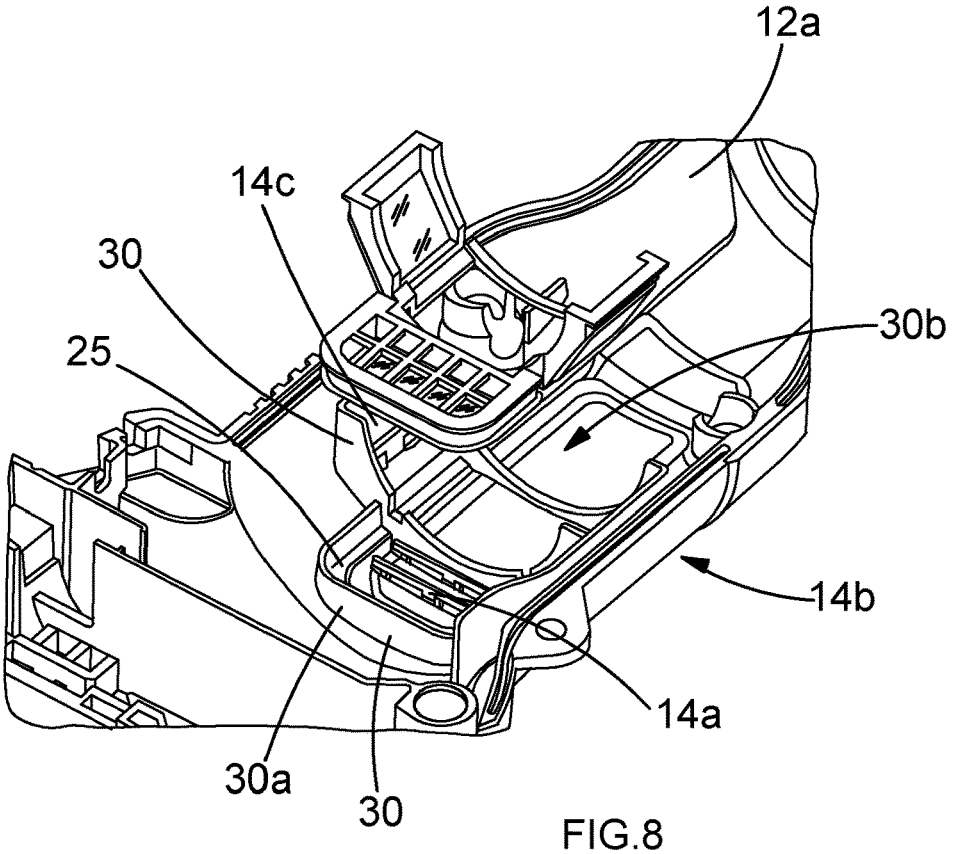
FIG. 8 illustrates the arrangement in FIG. 5 from a different angle.
Figure 9:
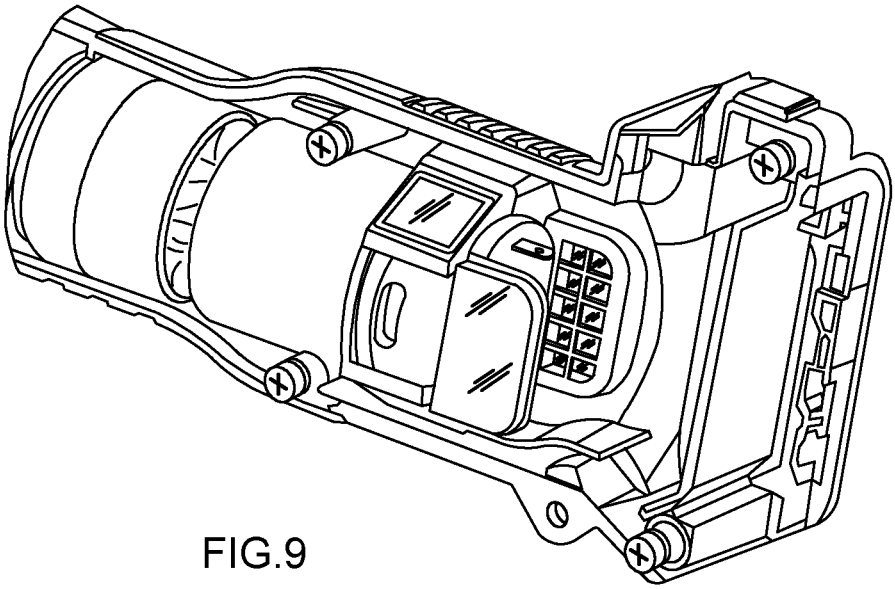
FIG. 9 is a schematic view illustrating the arrangement of the frames provided within the tool in FIG. 2 where a housing part has been removed.

In more detail, looking at FIG. 8, a first wall feature 30*a* having multiple sides is provided for surrounding the fourth frame section 16*d* in use. A second wall feature 30*b* having multiple sides is provided for surrounding the first to third frame sections 16*a* to 16*c* in use. FIG. 6 shows that when the frame 16 is received in the space defined by the above-mentioned wall features, the profile 27 of the bottom-side of the frame substantially aligns with the profile of the upper edges of the second wall feature 30*b*, whereas a lip extending from the fourth frame section 16*d* lies against the upper edges of the first wall feature 30*a*.

Figure 7:
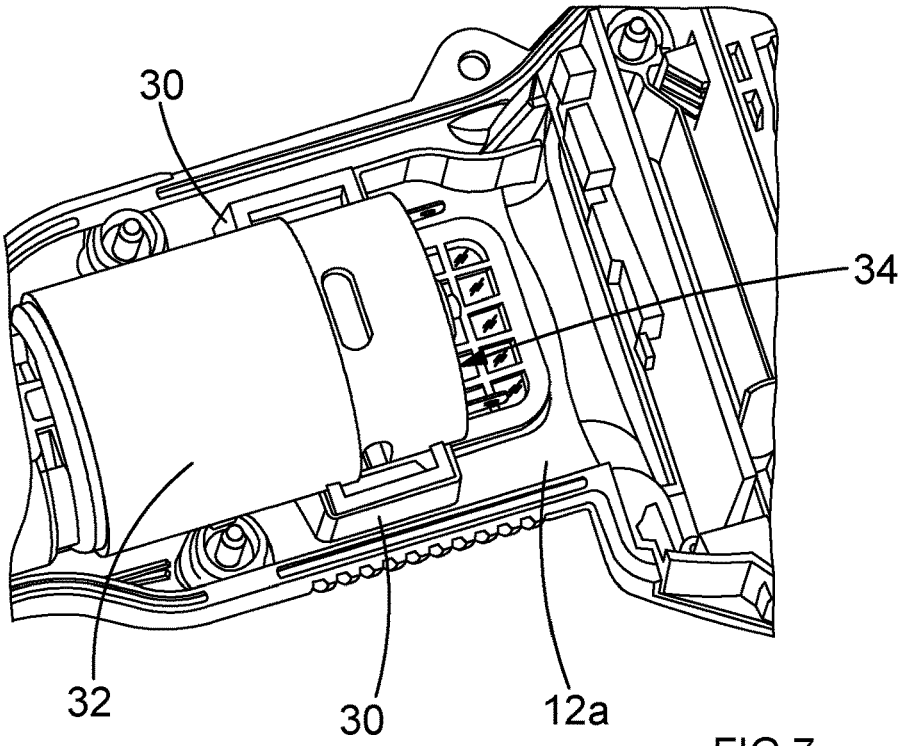
FIG. 7 illustrates a motor housing after being inserted into the arrangement of FIG. 6.

Components of the tool 10 are then arranged within the first tool housing part 12*a*, such as an electro-hydraulic actuating arrangement that includes an electric motor for actuating a pair of crimping jaws. It will be appreciated that other features necessary for operation of the tool are arranged inside the first tool housing part 12*a* at this stage. FIG. 7 illustrates a motor housing 32 of an electric motor arranged on top of a frame 16 that is engaged with the first tool housing part 12*a*. The profile 27 of the bottom-side of the frame 16, and also the profile of the top edges of the walls 30 of the second wall feature 30*b*, is complementary to the shape of the exterior of the motor housing 32. The frame 16 thus partially surrounds the motor housing 32, wherein the edges 29 (see FIG. 4*b*) of the first to third frame sections 16*a* to 16*c* in contact with the exterior of the motor housing 32 are in substantially flush alignment with the motor housing 32. The end face 34 of the motor housing abuts against a stop edge 36 defined by the fourth frame section 16*d* (see FIGS. 4*b* and 7). Like the other edges 29 mentioned previously the edge 29 at the interface between the second and fourth frame sections 16*b*, 16*d* which is adjacent the stopping edge 36 is a complimentary shape to the exterior of the motor housing 32.

The grid 26 defined by the fourth frame section 16*d* restricts components within the tool housing 12 from coming into contact with the partition member 28*c* and thereby damaging the partition member 28*c* during use.

A second tool housing part 12*b*, complementary to the first housing part 12*a* and also provided with a frame 16 similarly as illustrated in FIG. 6, is then coupled to the first tool housing part 12*a* for closing the tool 10. On doing so the frame 16 supported by the second tool housing part 12*b* surrounds the exposed side of the motor housing 32 illustrated in FIG. 7 in a similar manner to that heretofore described. When the first and second tool housing parts 12*a*, 12*b* are secured together the motor housing 32 is clamped between the housing parts 12*a*, 12*b* and the frames 16 on either side thereof (see FIG. 9).

In other words, due to the complementary shape of the frames 16 and the exterior of the motor housing 32, the frames 16 are clamped between a respective tool housing part 12*a*, 12*b* and the motor housing 32. That is the frame 16 on one side of the tool 10 is clamped between the first tool housing part 12*a* and the motor housing 32, whereas the frame 16 on the other side of the tool is clamped between the second tool housing part 12*b* and the motor housing 32. Such squeezing of the frames 16 between the motor housing 32 and the tool housing parts 12*a*, 12*b* biases the first, third and fourth frame sections 16*a*, 16*c*, 16*d* against the aforementioned edge portions surrounding the vent portions 14*a* to 14*c* in the respective tool housing parts 12*a*, 12*b*. Looking at FIG. 4*b*, the motor housing 32 bears against the edges denoted 29 in order to force the first, second and fourth frame sections 16*a*, 16*c*, 16*d* against the interior of the tool housing. The partition members 28*a*, 28*b*, 28*c* are thus pinched between the edge portions surrounding the vent portions 14*a* to 14*c* and the first, third and fourth frame sections 16*a*, 16*c*, 16*d* thereby forming a watertight seal around the vent portions, although while still permitting airflow.

With reference to FIG. 6 it has already been mentioned that when the frame 16 is moved into contact with the interior of the first tool housing part 12*a* the frame 16 is received within the space defined by the walls 30, which thereby act to restrict movement of the frame 16 except in a direction extending away from the inner surface of the first tool housing part 12*a*. However, it will be appreciated that when the tool 10 is assembled, and the motor housing 32 is clamped between opposite tool housing parts 12*a*, 12*b* the motor housing 32 restricts movement of the frame 16 in a direction extending away from the inner wall of the first tool housing part 12*a*. Thus, when the tool 10 is assembled movement of the frames 16 is restricted, which reduces the likelihood of misalignment between the partition members 28*a*, 28*b* 28*c* and the vent portions 14*a* to 14*c* during tool use.

It will be appreciated that in addition to providing protection from liquid water ingress, the partition members 28*a*, 28*b*, 28*c* heretofore described provide protection from dust ingress and the ingress of other particulates. In some embodiments the partition members have an IP (Ingress Protection) Rating of IP65.

It will also be appreciated that there is some design freedom in that the features heretofore described do not need to have the exact shape as illustrated in the drawings. For example, the first and third frame sections 16*a* and 16*c* may be triangular, the base of each triangle serving as the common edge with the second frame section 16*b*. In embodiments in which the frame 16 is shaped differently to as shown in the drawings, the arrangement of walls 30 protruding from the inner surface of the tool housing parts 12*a*, 12*b* is correspondingly different in order to receive the frame 16 when urged into engagement with the interior of a tool housing part. Furthermore, the motor housing 32 may be shaped differently to that as illustrated, thereby requiring the frame 16 and walls 30 to be correspondingly shaped differently in order to achieve the same effects as heretofore described. More specifically the profile 27 of the bottom-side of the frame 16 and the upper edges of the walls 30 would need to be adapted to correspond with the motor housing exterior.

In some embodiments the component clamped between opposing tool housing parts 12*a*, 12*b* and frames 16 need not necessarily be a motor housing 32. For example, another feature, such as a transmission containing a set of selectable gears for example, may be clamped between a pair of frames 16 inside a tool 10 instead.

In some embodiments the frame 16 need not necessarily comprise a plurality of frame portions and may instead comprise just a single frame portion for restricting liquid water ingress through a single vent portion in a tool housing.

A second aspect of the present invention is described with reference to FIGS. 10 to 16.

In some embodiments a rocker switch is provided on a support, wherein the periphery of the support is provided with a rubber overmold. During assembly of a power tool the support is clamped between respective parts of the tool casing, wherein internal surfaces of the respective casing parts cooperate with the rubber overmold to restrict the ingress of liquid water into the power tool. A rubber overmold is also provided around an opening in the support through which a plunger of the switch extends for further restricting the ingress of liquid water into the power tool. Details of example embodiments will now be described.

Figure 10:
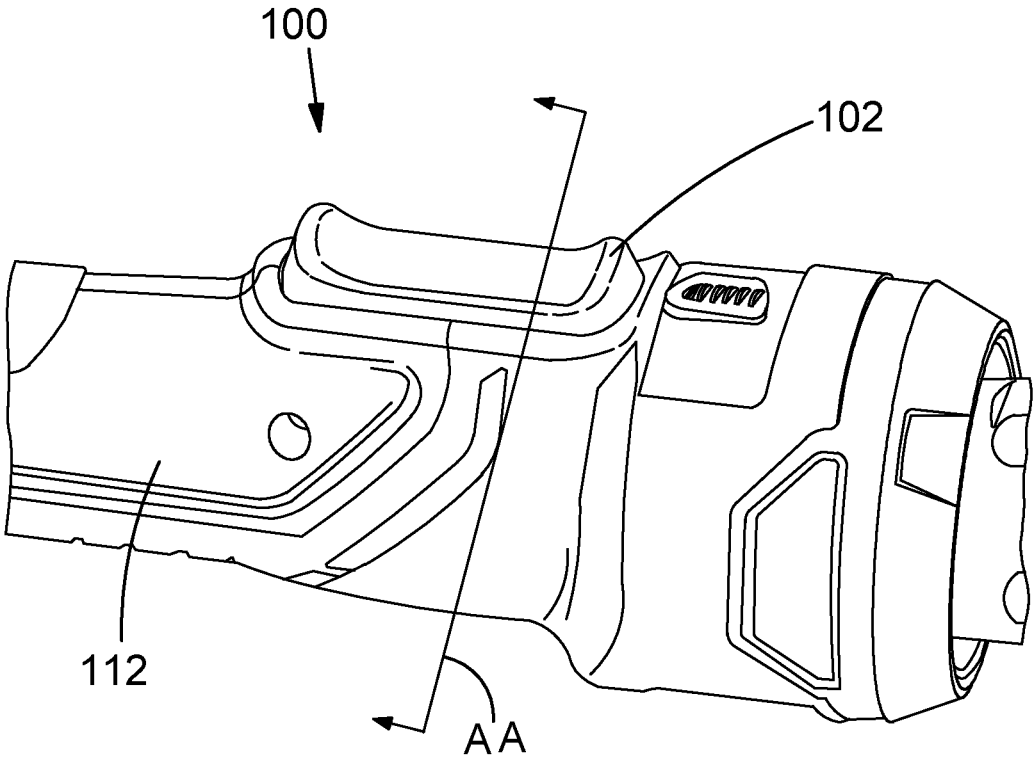
FIG. 10 illustrates a schematic perspective view of a tool switch viewed from outside of a tool.
Figure 11:
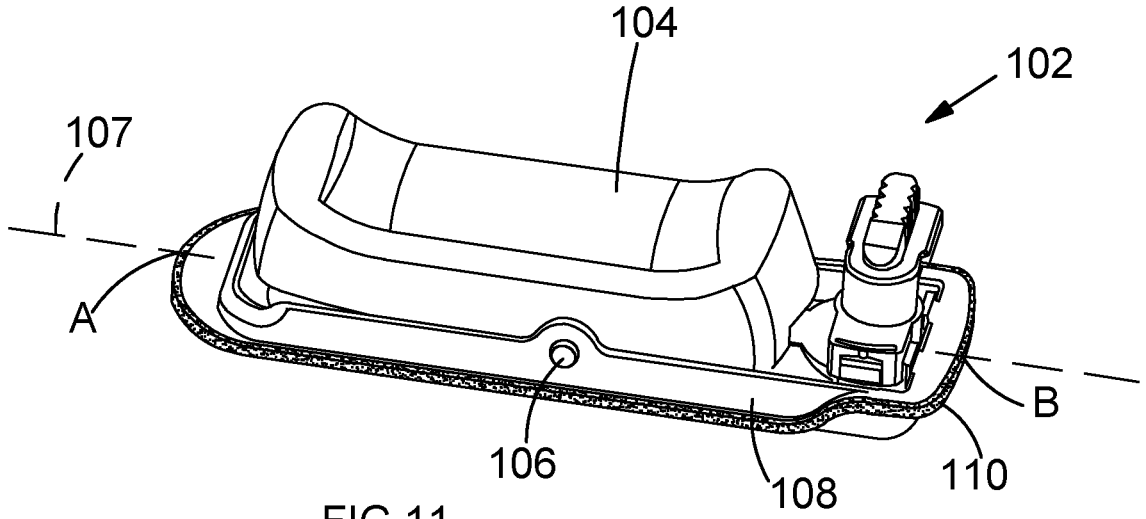
FIG. 11 is a schematic perspective view of the switch of the tool in FIG. 10.

FIG. 10 illustrates part of an electro-hydraulic crimping tool 100 with a switch 102 for influencing tool operation. With reference to FIG. 11 the switch 102 is of the rocker switch variety and so includes an actuation feature 104 that a user can manipulate to operate the tool 100. The actuation feature 104 is arranged to pivot around a pin 106. Internal electrical components of the switch 102 are obscured from view in FIG. 11, although nevertheless it will be appreciated that by pivoting the actuation feature 104 a user can control operation of electrical features of the tool 100 such as an electric motor for driving the actuation of jaws of the tool. The actuation feature 104 is provided on a support 108, wherein the support 108 is a plastic component having a rubber overmold feature 110 about its periphery.

Figure 12:
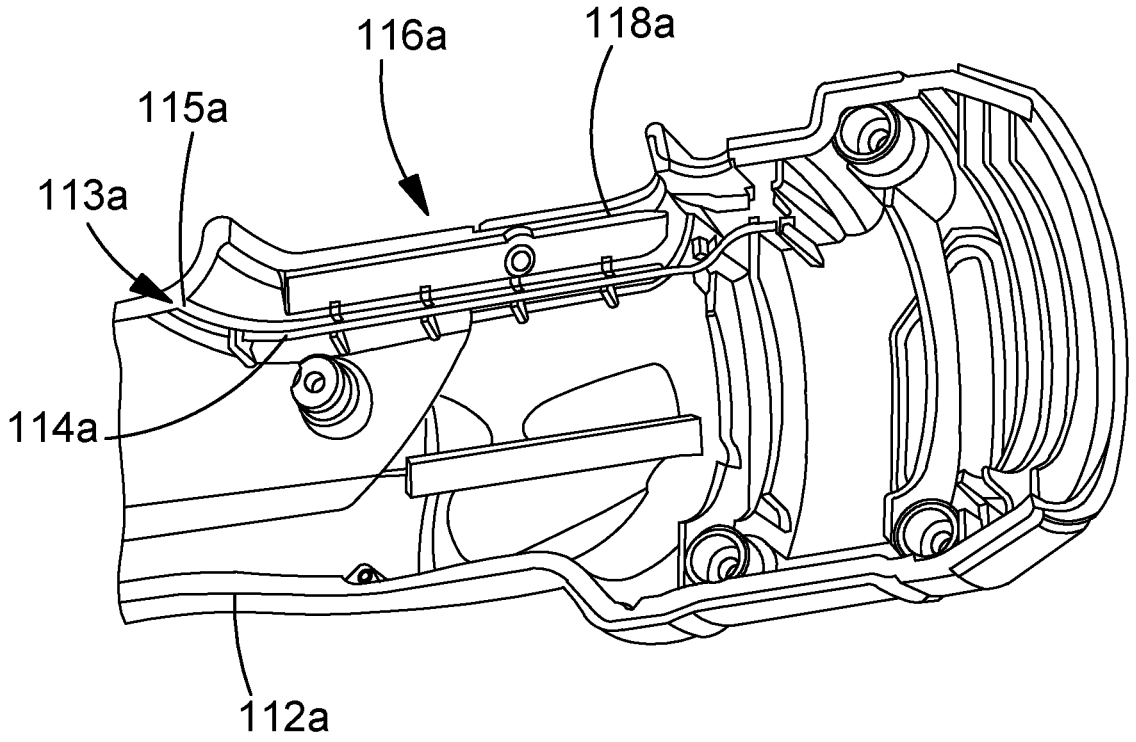
FIG. 12 is a schematic perspective view of half of the housing of the tool in FIG. 10.
Figure 13:
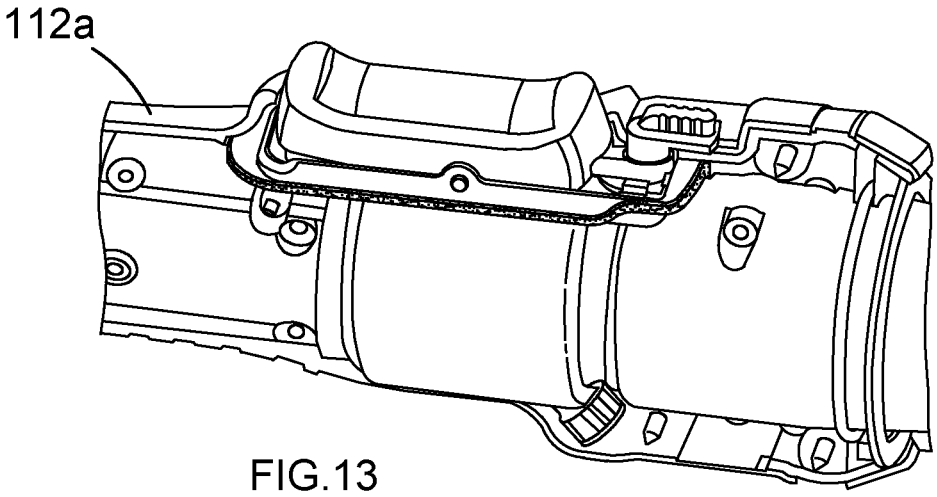
FIG. 13 is a schematic view of the tool in FIG. 10 part way during assembly thereof.
Figure 14:
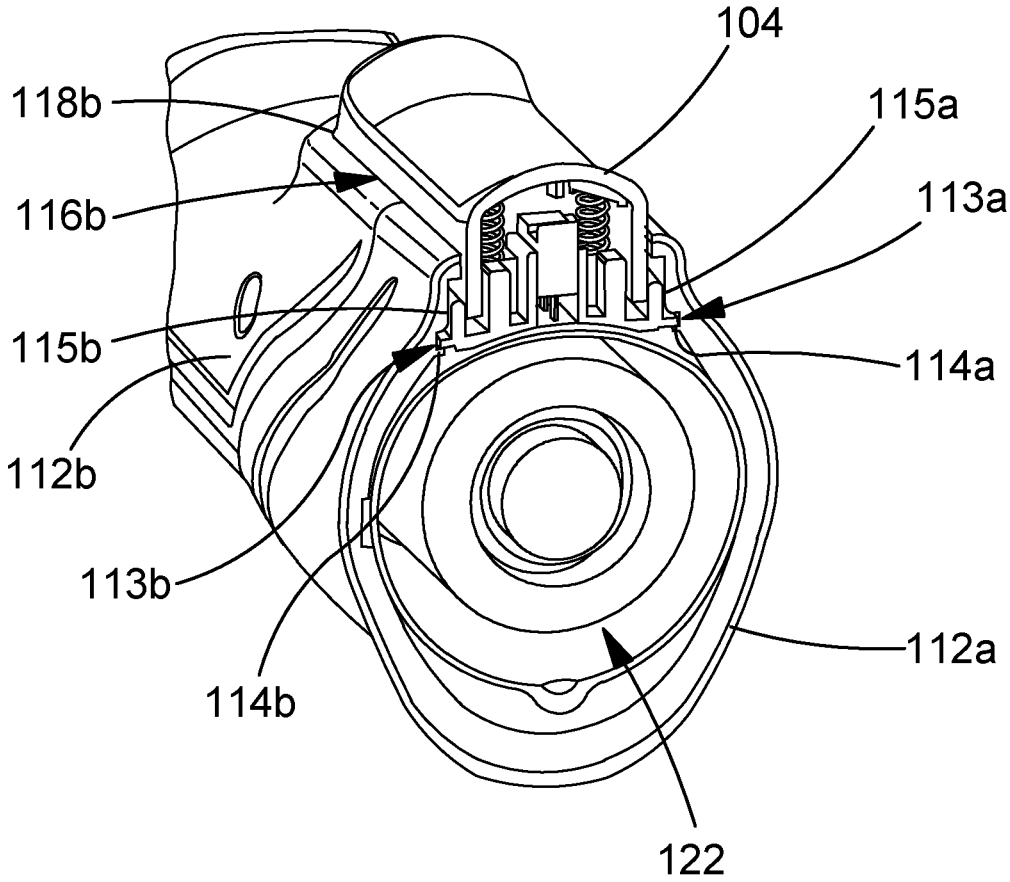
FIG. 14 is a cross sectional schematic view of the tool in FIG. 10 along the line A-A.

With reference to FIGS. 12 to 14, during tool assembly a first tool housing part 112*a* is provided. The first tool housing part 112*a* includes various standard features that will be familiar to persons skilled in the art such as screw openings for closing the housing 112 during assembly of the tool 100. Additionally, however, the first tool housing part 112*a* has a channel 113*a*, the base of which is defined by a protrusion 114*a* extending about the inner surface of the first tool housing part 112*a* and the upper surface 115*a* of which is defined by the curvature of the tool housing part.

Components of the tool 100 are arranged within the first tool housing part 112*a*, such as an electro-hydraulic mechanism that includes an electric motor for actuating crimping jaws of the tool. It will be appreciated that other features necessary for operation of the tool are arranged in the first tool housing part 112*a*.

The switch 102 is also arranged inside the first tool housing part 112*a* such that it engages an inner wall thereof. A first half of the support 108, in other words a half of the support 108 located on one side of the notional line 107 extending along the central axis of the support 108, is inserted into the first tool housing part 112*a* as illustrated in FIG. 13. In doing so the length of the rubber overmold 110 between the locations denoted A and B in FIG. 11 is caused to extend into the channel 113*a* and rest on the protrusion 114*a*, thereby engaging the inner wall of the first tool housing part 112*a*.

In the arrangement when the support 108 has been inserted in the first tool housing part 112*a*, the actuation feature 104 is located in a cavity 116*a* (see FIG. 12) defined by an upper section of the first tool housing part 112*a*, wherein a rim 118*a* thereof extends around part of the periphery of the actuation feature 104.

A second tool housing part 112*b*, complementary to the first housing part 112*a* and also provided with a channel 113*b*, similarly as illustrated in FIG. 12, is then coupled to the first tool housing part 112*a* for closing the tool 100 (see FIG. 14). On doing so the other half of the support 108 extends into the second tool housing part 112*b*, such that the remainder of the overmold feature 110 extends into the channel 113*b* and rests on the protrusion 114*b*, thereby engaging the inner wall of the second tool housing part 112*b*. Additionally, the actuation feature 104 is located in a cavity 116*b* corresponding to that illustrated in FIG. 12, wherein a rim 118*b* thereof extends around part of the periphery of the actuation feature 104 in a similar manner to that heretofore described.

From the foregoing when the first and second tool housing parts 112*a*, 112*b* are secured together the channels 113*a*, 113*b* cooperate to form a continuous channel extending about the interior of the tool housing 112. The protrusions 114*a*, 114*b* of the respective channels 113*a*, 113*b* thus cooperate to form a continuous lower edge and the upper surfaces 115*a*, 115*b* of the respective channels 113*a*, 113*b* cooperate to form a continuous upper edge. As a result, the upper and lower surfaces of the aforementioned continuous channel cooperate with the overmold feature 110 to retain the support 108 in place. Moreover, since the support 108 is clamped between the housing parts 112*a*, 112*b* the overmold feature 110 cooperates with the inner wall of the respective housing parts 112*a*, 112*b* to form a seal. As a result, if liquid water enters the tool 100 through the space between the rim 118*a*, 118*b* of the housing parts 112*a*, 112*b* and the actuation feature 104 this water is restricted by the seal mentioned in the previous sentence, from entering the inner chamber 122 of the tool housing 112 where electronic components such as an electric motor are located.

Figure 15:
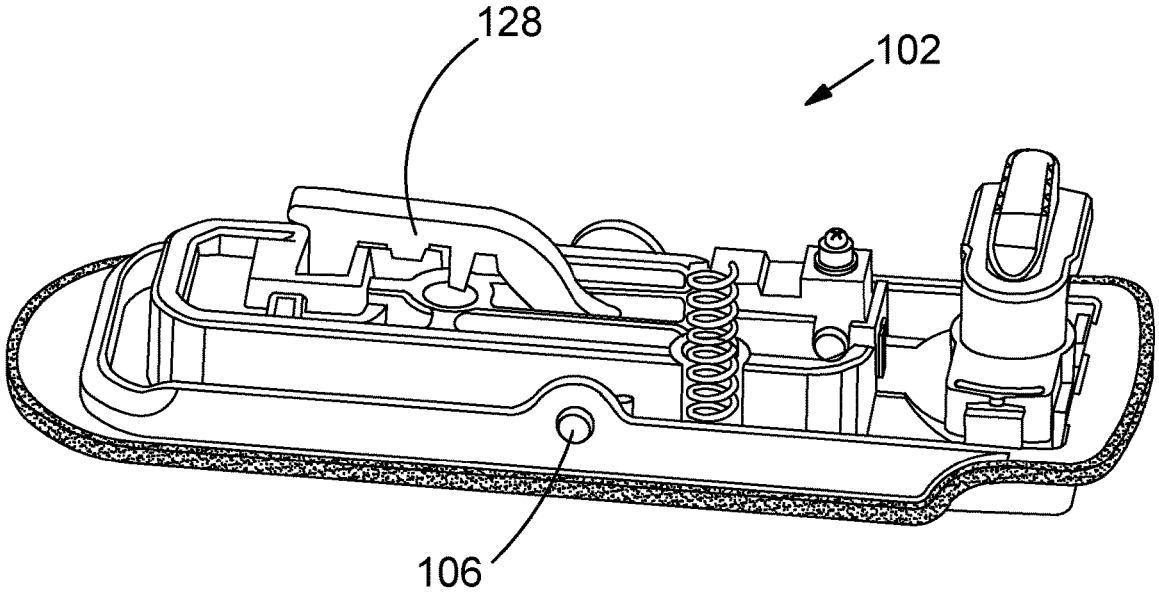
FIG. 15 is a schematic view of internal components of the switch in FIG. 11.
Figure 16:
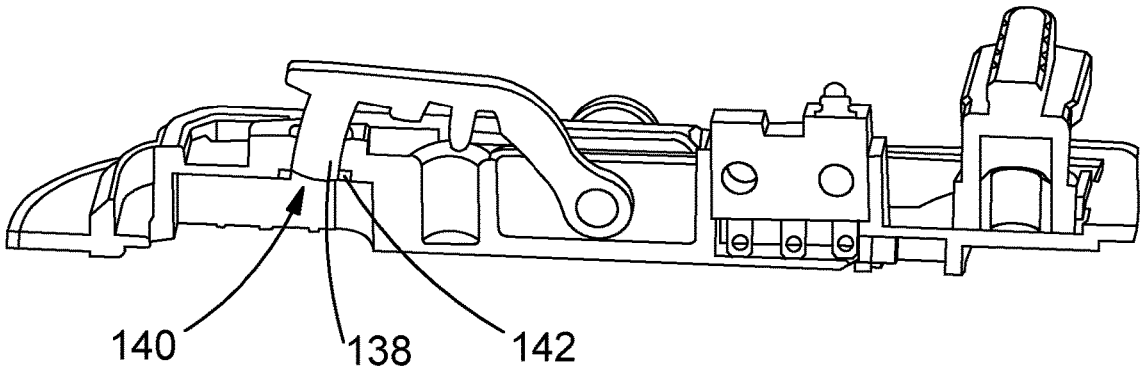
FIG. 16 is a cross sectional view of the arrangement in FIG. 15.

FIGS. 15 and 16 illustrate internal components of the switch 102. Since the switch 102 is of the rocker switch variety the switch includes, among other standard features that will be familiar to persons skilled in the art, a plunger 128 for transferring a force applied by a user to the actuation feature 104 to a component within the tool 100, for the purpose of, for example, controlling the electric motor of the tool 100. The plunger 128 has a finger 138 which is configured to extend through an opening 140 defined by the support 108 when the actuation feature 104 is pressed. An additional rubber overmold feature 142 is located within this opening 140 for sealing the space between the inner wall of the opening 140 and the external surface of the finger 138. As a result, if liquid water enters the space beneath the actuation feature 104 of the switch 102 this water is restricted by the rubber overmold feature 142 from entering the inner chamber 122 of the tool housing 112 where electronic components such at an electric motor reside.

It will be appreciated that there is some design freedom in that the features heretofore described in connection with FIGS. 10 to 16 do not need to have the exact shape and configuration as illustrated in the drawings.

In some alternative embodiments the support 108 may have a channel extending around its periphery instead of an overmold feature. In such embodiments the respective tool housing parts 112*a*, 112*b* may each be provided with an overmold feature instead of a channel, such that when the two housing parts 112*a*, 112*b* are coupled together the two overmold features cooperate to form a continuous overmold feature that extends around the interior of the tool housing 112 formed. More specifically in such embodiments when the support 108 of the switch 102 is clamped between the respective tool housing parts 112*a*, 112*b* similarly as heretofore described, the continuous overmold feature protruding from the interior of the tool housing 102 extends into the channel extending around the periphery of the support 108 for forming a seal to restrict the ingress of liquid water into the inner chamber 122 of the tool housing 102.

Furthermore, the overmold feature need not necessarily be formed of rubber but could comprise any other material suitable for fulfilling the purpose of providing a seal for restricting the ingress of liquid water.

Additionally, the switch 102 need not necessarily be of the rocker variety and in some embodiments can merely be some kind of actuator that a user can manipulate to influence tool operation, provided the actuator is provided on a support 108.

Although the second aspect of the present invention has been described in the context of a crimping tool it will be appreciated that it could be applied in the context of an electro-hydraulic cutting tool also.

A third aspect of the present invention is described with reference to FIGS. 17 to 20.

In some embodiments an electro-hydraulic crimping or cutting tool has a series of light emitting units for illuminating the operational part of the power tool (i.e. the crimping jaws or cutting jaws). The light emitting units are arranged next to one another in a manner such that the plurality thereof wraps around the tool housing, wherein they can be caused to change colour for indicating tool usage information to a user. In some embodiments the light emitting units can be a plurality of RGB LEDs. When a tool is initially turned on the light emitting units may emit white light solely for the purpose of illuminating the object to be cut or crimped. Following a good crimping or cutting cycle they may temporarily turn green, whereas following a bad crimping or cutting cycle they may temporarily turn red. Also, if the temperature of the tool becomes too hot the light emitting units may turn yellow or begin to flash. Nevertheless, since the light emitting units illuminate the operational part of the tool while in use, users are not required to remove their gaze from the object being operated on (e.g. the part of an object being crimped or cut) in order to be provided with tool usage information, nor are they required to change which of their hands grips the tool in order to be provided with such information.

Figure 17:
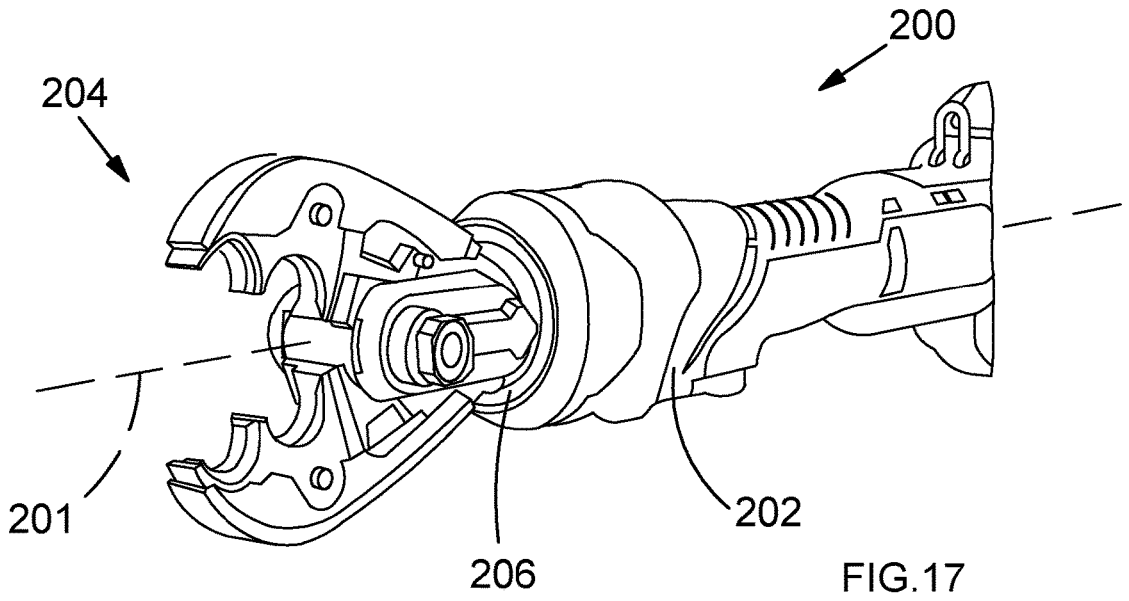
FIG. 17 illustrates a schematic view of an illumination feature of a power tool.
Figure 18:
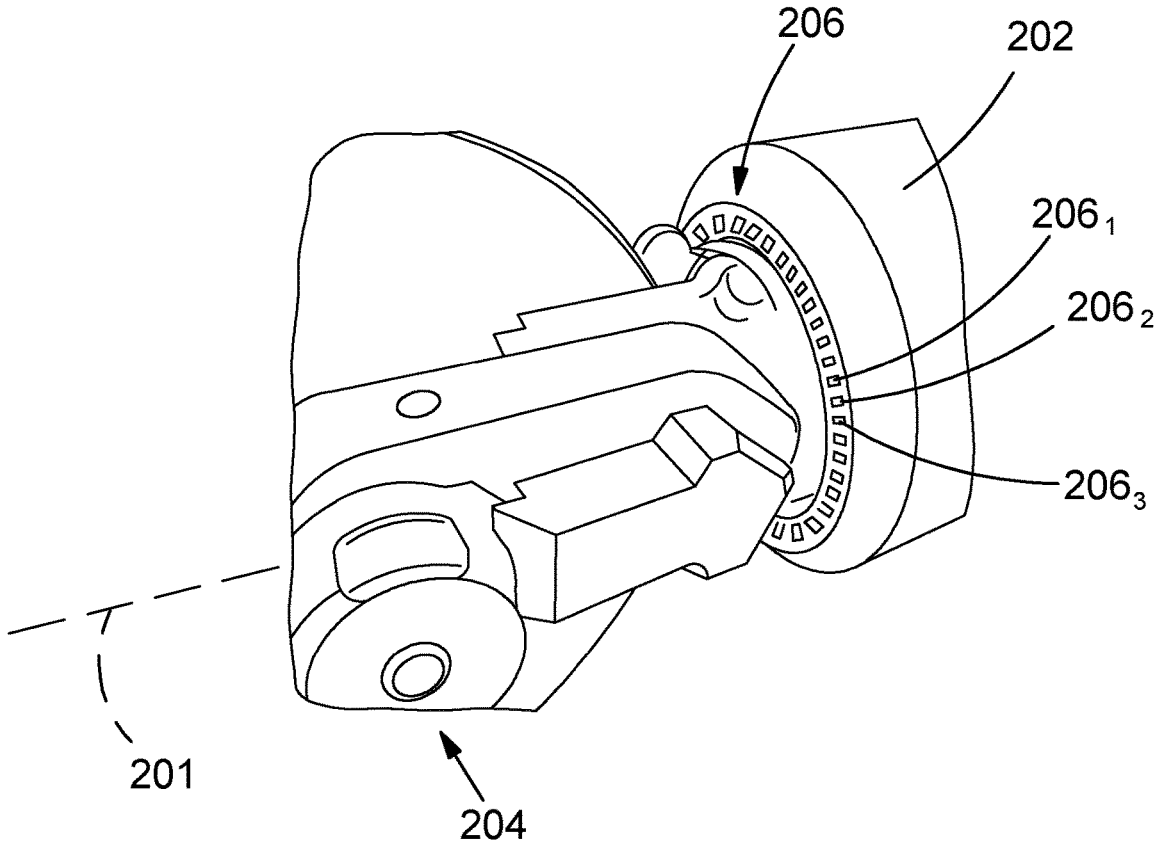
FIG. 18 is a schematic close up view of the illumination feature in FIG. 17.

FIG. 17 illustrates a portable electro-hydraulic tool 200 for crimping an object. The tool has a housing 202 in which features are provided for driving the crimping jaws 204. The tool 200 also has a series of light emitting units 206 arranged circumferentially around an end of the housing 202 adjacent the crimping jaws 204. More specifically, the light emitting units 206 are distributed in a plane that is orthogonal to a major axis 201 of the tool 200. A close up of the ring of light emitting units 206 is illustrated in FIG. 18 in which the light emitting units are denoted $\mathbf{206}_1$, $\mathbf{206}_2$, $\mathbf{206}_3$ to $\mathbf{206}_n$, where in some embodiments n is sixty, so in such embodiments one light emitting unit is provided every 6 degrees around the major axis 201 extending along the length of the tool 200. As is also clear from FIG. 18 the light emitting units $\mathbf{206}_1$ to $\mathbf{206}_n$ are each arranged to direct light towards the crimping jaws 204 (i.e. the working part of the tool which applies force to an object being crimped in use; cutting jaws in the case of a cutting tool) to illuminate an object being crimped.

In some embodiments the ring of light emitting units 206 is a ring of RGB LEDs e.g. part number P/N RING060 or P/N RING070 obtainable from the company Seko (Hong Kong) Technology Limited, Guangzhou Seko Lighting, 2 floor, No. 98 Tai an Road, shi ji town, panyu District, Guangzhou, China. In such embodiments the colour of light emitted by respective light emitting units (i.e. the respective RGB LEDs) can be selectively controlled by changing the intensity of red, green and blue light emitted from the RGB LEDs.

Figure 19:
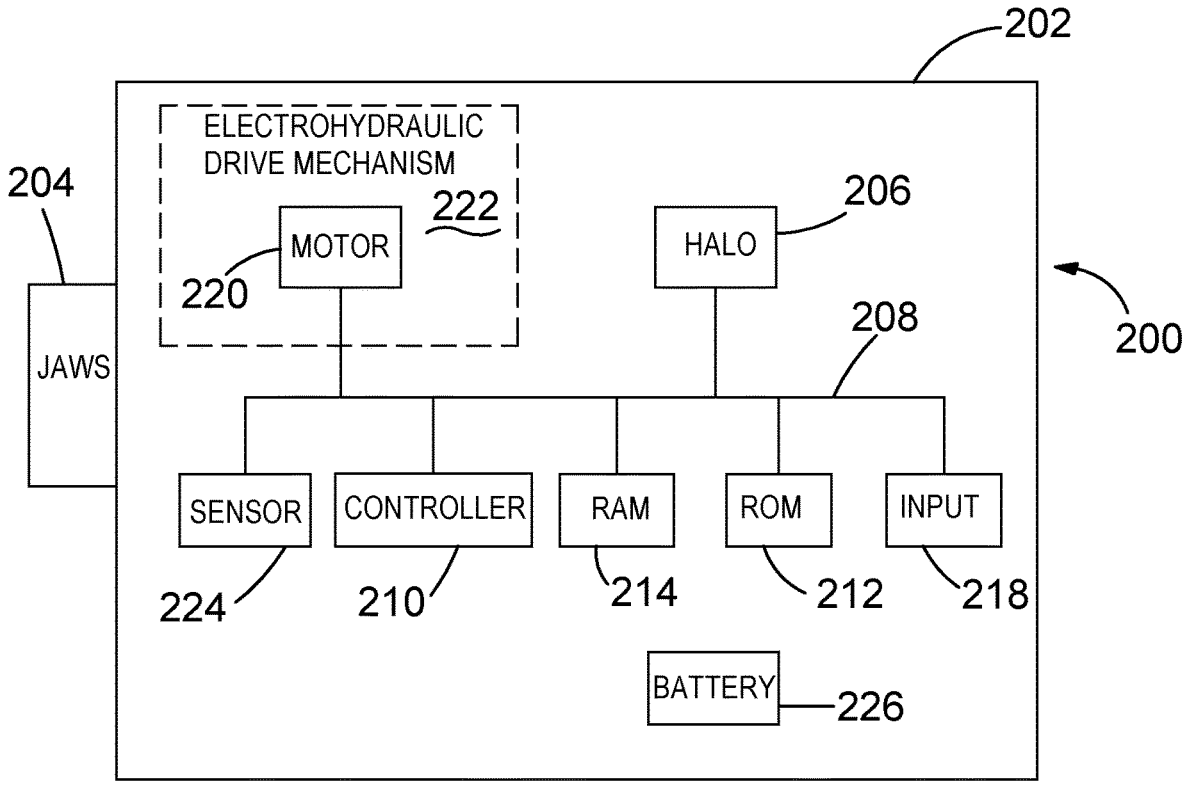
FIG. 19 is a schematic view of some internal components of the tool in FIG. 17.

A highly schematic drawing of components inside the tool 200 is illustrated in FIG. 19. A variety of components are shown coupled together by a system bus 208 that is used to transfer signals between the components, one of which is a controller 210. Additionally, non-volatile memory 212 and volatile memory 214 are also coupled to the system bus 208, wherein the controller 210 is configured to load program code stored in the non-volatile memory 212 into the volatile memory 214 for execution. The functionality that is caused to be implemented when such an application is executed by the controller 210 is discussed below, although initially however, other components coupled to the system bus 208 will be discussed first.

A user input arrangement 218 is connected to the system bus 208 for transmitting user input to the controller 210. This user input arrangement 218 can include a switch, such as a switch of the kind heretofore described in connection with FIGS. 10 to 16, and a transducer for cooperating with the switch for converting mechanical user input into electronic control signals for transmission to the controller 210.

An electric motor 220 of an electro-hydraulic drive mechanism 222 is connected to the system bus 208 for receiving control signals from the controller 210. The electric motor 220 can be used to drive the crimping jaws 204 via a hydraulic arrangement of the electro-hydraulic drive mechanism 222 in a manner that will be familiar to persons skilled in the art.

A current sensor 224 is connected to the system bus 208 for transmitting information to the controller 210 indicative of the magnitude of current being consumed by the electric motor 220. Based on this information the controller 210 can monitor progress of tool operation and make, for instance, a determination as to whether a crimping cycle is successful, incomplete or unsuccessful. Moreover, when a user indicates to the controller 210 a desire to crimp something via the user input arrangement 218 the controller 210 controls the tool 200 to undergo a crimping cycle by executing instructions pre-stored in the non-volatile memory 212 during manufacture, whereby the controller 210 controls components of the tool 200 accordingly to affect the crimping cycle by monitoring the progress of the crimping cycle based on the amount of current consumed by the electric motor 220. Persons skilled in the art will be familiar with techniques of automatically implementing crimping cycles and determining whether such crimping cycles are successful or not, for example the Neolec™ range of electro-hydraulic crimping tools from Dubuis et Cie, France (e.g. the BPL036 and the BPL055 inline crimping tools) monitor and thereby control the progress of crimping cycles based on differences in the rate of change of current consumed by a driving electric motor.

A ring of light emitting units of the kind heretofore described is referred to hereafter as a halo 206, whereby such a halo 206 is connected to the system bus 208 to enable the controller 210 to control the colour of light emitted thereby for indicting tool usage information to a user.

Additionally, a battery 226 is provided for powering the aforementioned components.

Figure 20:
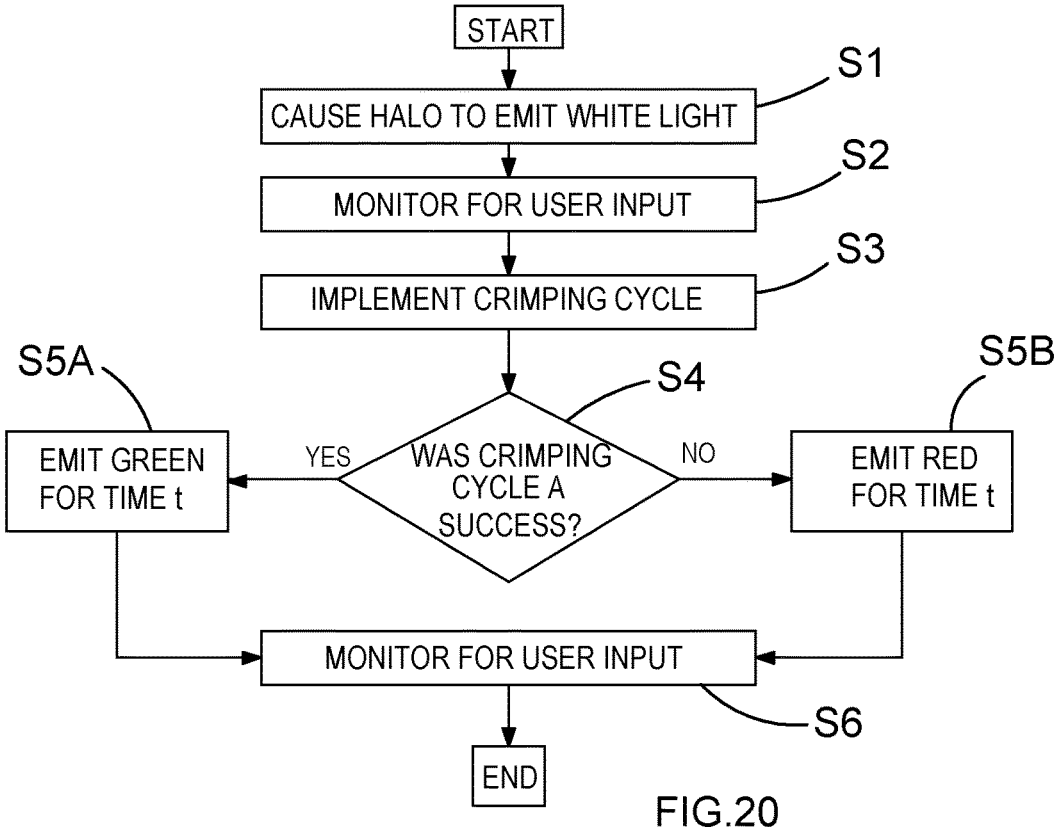
FIG. 20 is a method implemented by the tool in FIG. 17 in use.

When run, the aforementioned application causes the controller 210 to implement changes in the color of light being emitted by the halo 206 to indicate tool usage information to a user. For example, the controller 210 can be caused to give a visual indication to a user regarding whether an object has been successfully crimped or not. Such a process is illustrated in FIG. 20 and begins after the tool 200 is switched on, whereby in step S1 the controller 210 causes the halo 206 to emit white light.

In step S2 the controller 210 monitors for signals originating from the user input arrangement 218.

In step S3 the controller 210 responds to a user indication to begin crimping an object by executing crimping cycle control instructions pre-stored in non-volatile memory 212 during manufacture. Control signals are thus caused to be transmitted to the electric motor 220 to start driving the crimping jaws 204 via the hydraulic mechanism 222. Additionally, the controller 210 begins processing information received from the current sensor 224 which is indicative of the amount of current being consumed by the electric motor 220 in order to monitor and control operation of the tool 200 during the crimping cycle being implemented as heretofore described.

In step S4 the controller 210 determines whether the crimping cycle was a success or not, again as heretofore described, for example on the basis of information received from the current sensor 224 during the crimping cycle, or on the basis of whether a user indicated via the input arrangement 218 to stop the crimping process part way through a crimping cycle.

If yes, the crimping cycle is determined to have been a success, then in step S5A the controller 210 causes the halo 206 to emit light of a first predetermined colour (e.g. green light) for a predetermined amount of time, for example two seconds before returning to emit white light. If no, the crimping cycle is determined to have been unsuccessful or incomplete, then in step S5B the controller 210 causes the halo 206 to emit light of a second predetermined colour (e.g. red light) for a predetermined amount of time, for example two seconds before returning to emit white light.

Subsequently in step S6 the controller 210 monitors for further control information from the user input arrangement 218 to determine what to do next, wherein the process in FIG. 20 ends.

In some embodiments the sensor 224 may not be a current sensor and may instead be configured to give an output indicative of another parameter (e.g. the voltage consumed by the electric motor 220 or another component of the tool) for enabling the controller 210 to monitor and control the progress of a crimping cycle.

In some embodiments the tool 200 can have other sensors for transmitting to the controller 210 information indicative of the parameter being sensed, whereby the controller 210 can cause the halo 206 to give a visual indication of the occurrence of a pre-determined condition based on such information. In embodiments having multiple sensors the controller 210 can make a determination as to which condition has priority based on information pre-stored in the non-volatile 212.

In some embodiments the power tool 200 can for example additionally include a temperature sensor and the controller 210 can be configured to cause the halo 206 to start emitting light of a predetermined colour (e.g. yellow) when the temperature is determined to exceed a threshold amount. In some embodiments the controller 210 may instead be configured to cause the halo 206 to begin flashing, or give another visual indication, upon determining that the temperature has exceeded the threshold amount.

In some embodiments the tool 200 can include a battery power level sensor arrangement and the controller 210 can be configured to cause the halo 206 to start emitting light of a predetermined colour (e.g. purple) when the battery power level is determined to be below a threshold amount. In some embodiments the controller 210 may instead be configured to cause the halo 206 to begin flashing, or give another visual indication, upon determining that the remaining battery power level is less than the threshold amount.

In some embodiments the tool 200 can be configured to maintain a record of how many operational cycles it undergoes (in other words how many crimping cycles) by updating a flash memory for instance after each operational cycle and the controller 210 can be configured to cause the halo 206 to give a visual indication when a predetermined number of operational cycles is reached (e.g. flash red).

In some embodiments, if the controller 210 determines that a tool malfunction has occurred it controls the halo 206 to emit red light continuously.

In some embodiments the light emitting units 206 may not be circumferentially distributed around the housing 102 as heretofore described in connection with FIGS. 17 to 20. In some embodiments the light emitting units may be arranged in a polygonal arrangement around the tool housing 102, for instance in a square or triangle arrangement, although they are still arranged to emit light towards the jaws.

In some embodiments the light emitting units 206 may not be provided in a continuous arrangement (e.g. a circle) and may instead be provided offset from one another. For example, separate light emitting units may be provided at respective locations corresponding to the corners of a square or a triangle, provided they are arranged to emit light towards the jaws for illuminating an object being crimped.

In some embodiments the tool may not illuminate the jaws with white light as a standard condition, thereafter subsequently changing colour to indicate the occurrence of a predetermined condition. In other words, the jaws may not be illuminated to assist a user in positioning the tool before initiating a crimping or cutting cycle, whereas in some embodiments users have the option to select whether this occurs or not, for example to save battery life if the tool is used outside in good lighting conditions.

Although the embodiments described in connection with FIGS. 17 to 20 have been described in the context of electro-hydraulic crimping tools, in other embodiments the tool 200 may be an electro-hydraulic cutting tool and the crimping jaws 204 replaced by cutting jaws.

Furthermore, whilst illustrative embodiments have been described in connection with FIGS. 17 to 20 as employing software it will be appreciated by persons skilled in the art that the functionality provided by such software may instead be provided by hardware (for example by one or more application specific integrated circuits), or indeed by a mix of hardware and software.

Although the first, second and third aspects of the present invention have been described separately it will be appreciated that a power tool (such as a portable inline electro-hydraulic crimping or cutting tool as heretofore described, a portable pistol grip type electro-hydraulic crimping or cutting tool or otherwise) could embody one or more of such aspects in any combination thereof.

Although aspects and embodiments of the present invention have primarily been described in the context of portable electro-hydraulic tools for cutting or crimping objects it will be appreciated that such aspects and embodiments could be applied in other types of electric power tool such as battery powered drills or otherwise. For example, an electric drill or other portable electric power tool could have vents in its housing that are closed off by partition members of the type described in connection with FIGS. 2 to 9. An electric drill or other portable electric power tool could be provided with a switch of the type described in connection with FIGS. 10 to 16. Furthermore, an electric screwdriver or other portable electric power tool could be provided with an arrangement of light emitting units as described in connection with FIGS. 17 to 20 for illuminating the operative part of the tool and providing a user with a visual indication upon the determination of a predetermined condition.

Finally, it will be appreciated that whilst various aspects and embodiments have heretofore been described, the scope of the present invention is not limited thereto and instead extends to encompass all methods and arrangements, and modifications and alterations thereto, which fall within the spirit and scope of the appended claims.

It will be appreciated by persons skilled in the art that the above embodiments have been described by way of example only, and not in any limitative sense, and that various alterations and modifications are possible without departure from the scope of the invention as defined by the appended claims.

What is claimed is:

1. A power tool for crimping or cutting an object, the power tool comprising:

electrical components including an electric motor;

a pressure generating mechanism operable by the electric motor;

a tool head operable by the pressure generating mechanism for crimping or cutting the object;

a tool housing defining a vent portion to enable airflow within the tool housing for cooling of the electric motor;

a frame portion urged against the interior of the tool housing and surrounding the vent portion, the frame portion being urged against the tool housing by cooperating with a component of the power tool within the tool housing, wherein the frame portion has an inner profile corresponding in shape to the exterior of the component which wedges the frame portion against the interior of the tool housing; and a partition member configured to restrict passage of liquid water while permitting airflow therethrough, wherein the partition member is pinched between the interior of the tool housing and the frame portion such that the partition member extends across the vent portion for restricting ingress of liquid water into contact with electrical components within the tool housing while permitting airflow.

2. The power tool of claim 1 wherein the tool housing defines a plurality of vent portions to enable airflow for cooling of the electric motor and respective partition members are pinched between the tool housing interior and respective frame portions surrounding the vent portions for restricting ingress of liquid water into contact with electrical components within the tool housing while permitting airflow, the frame portions comprising separate parts of a frame body.

3. The power tool of claim 2 wherein at least one of the frame portions can pivot relative to the rest of the frame body prior to being provided within the power tool.

4. The power tool of claim 2 wherein the power tool has a plurality of said frame bodies wedged between the tool housing interior and the component of the power tool within the tool housing, a first frame body being provided on one side inside the tool housing and a second frame body being provided on the other side inside the tool housing such that the partition members are pinched and thereby cooperate with the vent portions on respective sides of the power tool.

5. The power tool of claim 1 wherein the component is a motor housing of the electric motor.

6. The power tool of claim 1 wherein the interior of the tool housing is provided with at least one feature that forms an interference fit with the frame portion to restrict movement thereof.

7. A method of assembling a power tool comprising the steps of:

providing:

an electrical component including an electric motor;

a pressure generating mechanism operable by the electric motor;

a tool head operable by the pressure generating mechanism for crimping or cutting an object;

a first part of a tool housing which defines a vent portion to enable airflow within the tool housing in use;

a second part of a tool housing;

a frame portion; and a partition member configured to restrict passage of liquid water while permitting airflow therethrough;

arranging the frame portion supporting the partition member within the first part of the tool housing such that the partition member extends across the vent portion;

locating the pressure generating mechanism including the electrical component and the electric motor within the first part of the tool housing;

urging the frame portion against the tool housing by cooperating with the electrical component within the tool housing; and closing the tool housing by causing the first part of the tool housing to cooperate with the second part of the tool housing, such that when the tool housing is closed, the electrical component within the tool housing wedges the frame portion against the interior of the tool housing, and the partition member is pinched between the interior of the tool housing and the frame portion for restricting ingress of liquid water into contact with electrical components within the tool housing while permitting airflow.

8. The power tool of claim 1 wherein the frame portion includes a grid for supporting the partition member in the vent portion.

9. The power tool of claim 1 wherein the inner profile of the frame portion faces inward and is complementary to an exterior shape of the electric motor or other tool component inward thereof.

10. The power tool of claim 1 wherein the tool housing includes a plurality of walls projecting inward therefrom, and the walls receive the frame portion and the partition member to locate and pinch them against the interior of the tool housing surrounding the vent portion.

11. The power tool of claim 1 wherein the frame portion includes a first frame section and a second frame section connected along a flexible common edge that enables the first frame section to pivot relative to the second frame section about the common edge.

12. The power tool of claim 11 wherein the vent portion includes a first vent portion and a second vent portion, and the partition member includes a first partition member and a second partition member, and the first frame section is urged against the interior of the tool housing surrounding the first vent portion with the first partition member pinched between, and the second frame section is urged against the interior of the tool housing surrounding the second vent portion with the second partition member pinched between.

13. A power tool for crimping or cutting an object, the power tool comprising:

a tool housing including a first housing part which defines a vent opening therethrough to allow airflow within the tool housing;

an electrical component located within the tool housing and including an electric motor and a pressure generating mechanism operable by the electric motor;

a tool head connected to the tool housing and operable by the pressure generating mechanism for crimping or cutting the object;

a membrane allowing airflow therethrough but acting as a moisture barrier; and a frame inside of the tool housing and supporting the membrane against and over the vent opening, the frame urged outward against the first housing part by cooperating with the electrical component located inward, wherein the frame has an inner profile corresponding in shape to the exterior of the electrical component which wedges the frame against the interior of the tool housing.

14. The power tool of claim 13 wherein the electrical component urging the frame against the interior of the first housing part is the electric motor.

15. The power tool of claim 13, wherein the membrane extends across the vent opening for restricting ingress of liquid water into contact with electrical components within the tool housing while permitting airflow.

16. The power tool of claim 13, wherein the frame includes a first frame portion and a second frame portion and wherein the first frame portion can pivot relative to the second frame portion prior to being fixed within the power tool.

17. The power tool of claim 13 wherein the frame includes a plurality of frames urged outward against the tool housing by the electrical component.

18. The power tool of claim 13 wherein the inner profile of the frame faces toward and is complimentary to an outer profile of the electrical component urging the frame against the interior of the first housing part.

19. The power tool of claim 13 wherein the first housing part includes a plurality of ribs projecting inward therefrom, and the ribs receive the frame and the membrane to locate them against the interior of the first housing part surrounding the vent opening.

20. The power tool of claim 17 wherein the electrical component is clamped between the frames.

* * * * *